US010897082B1

(12) United States Patent
Legare

(10) Patent No.: US 10,897,082 B1
(45) Date of Patent: Jan. 19, 2021

(54) STEERABLE PHASED ARRAY ANTENNA

(71) Applicant: GOVERNMENT OF THE UNITED STATES AS REPRESENTED BY THE SECRETARY OF THE AIR FORCE, Rome, NY (US)

(72) Inventor: David J. Legare, Ava, NY (US)

(73) Assignee: The United States of America as represented by the Secretary of the Air Force, Washington, DC (US)

( * ) Notice: Subject to any disclaimer, the term of this patent is extended or adjusted under 35 U.S.C. 154(b) by 285 days.

(21) Appl. No.: 15/920,568

(22) Filed: Mar. 14, 2018

Related U.S. Application Data

(60) Provisional application No. 62/478,285, filed on Mar. 29, 2017, provisional application No. 62/492,998, filed on May 2, 2017, provisional application No. 62/546,018, filed on Aug. 16, 2017.

(51) Int. Cl.

| | |
|---|---|
| ***H01Q 3/40*** | (2006.01) |
| ***H01Q 3/26*** | (2006.01) |
| ***H01Q 21/06*** | (2006.01) |
| ***H01Q 21/22*** | (2006.01) |

(52) U.S. Cl.
CPC ..... *H01Q 3/40* (2013.01); *H01Q 3/2694* (2013.01); *H01Q 21/065* (2013.01); *H01Q 21/22* (2013.01)

(58) Field of Classification Search
CPC ..... H01Q 3/2694; H01Q 3/28; H01Q 3/30; H01Q 3/40; H01Q 21/22; H01Q 21/065
See application file for complete search history.

(56) References Cited

U.S. PATENT DOCUMENTS

| | | | | |
|---|---|---|---|---|
| 5,339,086 | A * | 8/1994 | DeLuca | H01Q 3/22 342/371 |
| 5,694,134 | A | 12/1997 | Barnes | |
| 5,940,030 | A | 8/1999 | Hampel et al. | |
| 10,170,833 | B1 * | 1/2019 | Hollenbeck | H01Q 3/26 |

(Continued)

OTHER PUBLICATIONS

Abdellatif, A., et al., "Novel Low Cost Compact Phased Array Antenna for Millimeter-wave 3D Beam Scanning Applications," Antennas and Propagation Society International Symposium (APSURSI), 2014 IEEE, pp. 1145-1146, Sep. 22, 2014.

(Continued)

*Primary Examiner* — Dao L Phan
(74) *Attorney, Agent, or Firm* — Adam G Pugh

(57) ABSTRACT

An apparatus, system, and method for a steerable phased array antenna having a plurality of antenna elements disposed in a predetermined number of rows, M, and a predetermined number of columns, N, wherein M and N are positive integers; a M number of first beamformer components including phase tapers, wherein each first beamformer component corresponds to a row of antenna elements, and wherein each first beamformer component is operatively connected to the N number of antenna elements in the corresponding row; and a N number of second beamformer components including phase tapers, wherein each second beamformer component corresponds to a column of antenna elements, and wherein each second beamformer component is operatively connected to the M number of antenna elements in the corresponding column.

19 Claims, 11 Drawing Sheets

(56) References Cited

U.S. PATENT DOCUMENTS

| | | | | |
|---|---|---|---|---|
| 2003/0179139 | A1* | 9/2003 | Nemit | H01Q 3/26 342/383 |
| 2015/0378241 | A1 | 12/2015 | Eldada | |

OTHER PUBLICATIONS

Ehyaie, D., "Novel Approaches to the Design of Phased Array Antennas," Dissertation for Doctor of Philosophy degree, The University of Michigan, 2011, 153 pages.

* cited by examiner

STEERABLE PHASED ARRAY ANTENNA

CROSS-REFERENCE TO RELATED APPLICATION(S)

This application claims the benefit of U.S. Provisional Patent Application No. 62/478,285 filed on Mar. 29, 2017; U.S. Provisional Patent Application No. 62/492,998 filed on May 2, 2017; and U.S. Provisional Patent Application No. 62/546,018 filed on Aug. 16, 2017; the complete disclosures of which are incorporated herein by reference in their entireties.

GOVERNMENT INTEREST

The invention described herein may be manufactured and used by or for the Government of the United States for all government purposes without the payment of any royalty.

BACKGROUND

Field of the Invention

The embodiments herein generally relate to phased array antennas, and more particularly to steerable phased array antennas with reduced numbers of beamformer components.

Background of the Invention

In conventional phased array antenna design, there is typically at least one beamformer per antenna element. This can result in very complex and expensive circuit packaging design due to the size of the components and large number of control connections for the beamformer hardware, and the requirement to maintain proper RF feed line lengths between the beamformers and their respective antenna elements. Regulatory issues requiring larger apertures typically cause an increase proportional to the square of length of one side in the number of required elements, and consequently further increases the system cost and complexity. Accordingly, the practical implementation of the phased array antenna system may become unmanageable for all but small aperture antennas, which limits the scope for use of this technology.

Traditionally, an N×N element phased array antenna requires $N^2$ phase shifters (i.e., beamformers). These are typically monolithic microwave integrated circuits (MMICs) costing around $40 to $50 each, and are the most expensive part of the production antenna. With an antenna element spacing of λ/2, and the need for the phase shifters to be located close to and equidistant from each corresponding patch element, packing in the Z direction is required, thus making the antenna thicker and having a higher profile. This also greatly complicates packaging complexity and cost.

A number of technologies have been employed to mitigate the above. These include smaller MMIC packages and lower loss components and RF transmission line designs. These help to reduce packaging density and the number of other system components such as amplifiers (PAs and LNAs). However, it appears that the only path to a meaningful reduction in the antenna size, complexity, and manufacturing cost is a new system architecture that eliminates or significantly reduces the requirements for phase and amplitude control at each antenna element.

BRIEF SUMMARY OF THE INVENTION

In view of the foregoing, an embodiment herein provides an apparatus for a steerable phased array antenna comprising a plurality of antenna elements disposed in a predetermined number of rows, M, and a predetermined number of columns, N, wherein M and N are positive integers; a M number of first beamformer components comprising phase tapers, wherein each first beamformer component corresponds to a row of antenna elements, and wherein each first beamformer component is operatively connected to the N number of antenna elements in the corresponding row; and a N number of second beamformer components comprising phase tapers, wherein each second beamformer component corresponds to a column of antenna elements, and wherein each second beamformer component is operatively connected to the M number of antenna elements in the corresponding column, wherein each of the antenna elements comprise a plurality of combiners each having a first input, a second input, and an output, wherein each input being operatively connected to a corresponding beamformer so as to combine a first phase tapered RF signal from the first beamformer component corresponding to the row of the corresponding antenna element with a second phase tapered RF signal from the second beamformer component corresponding to the column of the corresponding antenna element; a phase adjustor element to selectively add a phase shift or time delay to an RF signal output from a combiner; a variable gain amplifier to adjust the amplitude of the RF signal output; and an antenna radiating element to radiate an RF signal into free space.

A first phase taper corresponding to a first beamformer component is 2×mα and a second phase taper corresponding to a second beamformer component is 2×nβ, wherein m is the row number of the corresponding antenna element ≥1 and ≤M, n is the column number of the corresponding antenna element ≥1 and ≤N, $\alpha=Kd_x \sin(\theta)\cos(\varphi)$, $\beta=Kd_y \sin(\theta)\sin(\varphi)$, $$K = \frac{2\pi}{\lambda},$$

λ is a wavelength, $d_x$ is antenna element spacing in the row direction, $d_y$ is antenna element spacing in the column direction, and (θ, φ) is the spherical coordinate pointing angle of the steerable phased array antenna, wherein $d_x=d_y=\lambda/2$.

The phase adjustor element may be configured to add a π radians phase delay to the RF signal output from the combiner when $\cos(\omega t+(m\alpha+n\beta))$ and $(\cos(\omega t+2m\alpha)+\cos(\omega t+2n\beta))$ are substantially 180 degrees out of phase with each other, wherein t is time variance and ω is the frequency of the RF signal output. The apparatus may further comprise a plurality of first signal paths operatively connecting the first beamformer components to the antenna elements in the corresponding row by equal path lengths; and a plurality of second signal paths operatively connecting the second beamformer components to the antenna elements in the corresponding column by equal path lengths. The signal paths may comprise strip lines or transmission lines. An RF signal entering first and second inputs of the combiner are substantially of equal amplitude. The apparatus may comprise a controller operably connected to each of the beamformer components, the variable gain amplifier, and the phase adjustor element to generate the phase tapers, a variable RF signal amplitude, and relative RF signal phases associated with each radiating antenna element which correspond to any commanded pointing angle (θ, φ) and beam pattern.

The apparatus may comprise a plurality of RF signals derived from a single originating RF signal that has been fed in-phase into each of the first and second beamformer components and subsequently phase shifted or time delayed in the first and second beamformer components by a unique phase taper value applied by an external control mechanism to each of the first and second beamformer components.

Another embodiment provides a system comprising a steerable phased array antenna and a controller therefor, wherein the steerable phased array antenna comprises a plurality of antenna elements disposed in a predetermined number of rows, M, and a predetermined number of columns, N, wherein M and N are positive integers; a M number of first beamformer components comprising phase tapers, wherein each first beamformer component corresponds to a row of antenna elements, and wherein each first beamformer component is operatively connected to the N number of antenna elements in the corresponding row; and a N number of second beamformer components comprising phase tapers, wherein each second beamformer component corresponds to a column of antenna elements, and wherein each second beamformer component is operatively connected to the M number of antenna elements in the corresponding column, wherein each of the antenna elements comprise a plurality of combiners each having a first input, a second input, and an output, wherein each input being operatively connected to a corresponding beamformer component and configured to combine a first phase tapered RF signal from the first beamformer component corresponding to a row of a corresponding antenna element with a second phase tapered RF signal from the second beamformer component corresponding to a column of a corresponding antenna element; a variable gain amplifier to adjust the amplitude of an RF signal; an antenna radiating element for radiating the RF signal into free space; and a phase corrector to add a $\pi$ radian phase delay to the output from a combiner when $\cos(\omega t+(m\alpha+n\beta))$ and $(\cos(\omega t+2m\alpha)+\cos(\omega t+2n\beta))$ are substantially 180 degrees out of phase with each other, wherein t is time variance and $\omega$ is the frequency of the RF signal, wherein a phase taper applied to the first beamformer component is $2\times m\alpha$; and wherein the phase taper applied to the second beamformer component is $2\times n\beta$; m is the row number of a corresponding antenna element $\geq 1$ and $\leq M$; n is the column number of the corresponding antenna element $\geq 1$ and $\leq N$; $\alpha=Kd_x \sin(\theta) \cos(\varphi)$; $\beta=Kd_y \sin(\theta) \sin(\varphi)$;

$$K = \frac{2\pi}{\lambda},$$

$\lambda$ is wavelength of the RF signal; $d_x$ is antenna element spacing in the row direction; $d_y$ is antenna element spacing in the column direction; and $(\theta, \varphi)$ is the spherical coordinate pointing angle of the steerable phased array antenna, wherein the controller, being responsive to commands to steer the steerable phased array antenna, receives the pointing angle $(\theta, \varphi)$ and generates phase taper values to be applied to the first and second beamformer components.

The first and second beamformer components may employ one of either phase shifters or delay lines component types. The system may comprise a plurality of first signal paths operatively connecting the first beamformer components to the antenna elements in the corresponding row by equal path lengths; and a plurality of second signal paths operatively connecting the second beamformer components to the antenna elements in the corresponding column by equal path lengths. The plurality of first and the second signal paths may comprise a plurality of strip lines or transmission lines. The variable gain amplifier may comprise a phase invariant variable gain function. In an embodiment, $d_x=d_y=\lambda/2$. Furthermore, an M+N number of first and second beamformer components may provide a combined first and second phase tapered RF signals to $M\times N$ number of antenna elements through $M\times N$ number of combiners.

Another embodiment provides, in an electronically steerable phased array antenna comprising rows and columns of antenna elements and RF signal paths connected thereto, a method comprising receiving a predetermined pointing angle $(\theta, \varphi)$ to steer the steerable phased array antenna; generating first and second phase taper values for each of M rows and N columns of antenna elements comprising the steerable phased array antenna corresponding to the predetermined pointing angle $(\theta, \varphi)$, wherein M and N are positive integers; applying the phase tapers to signals corresponding to each of the M rows and N columns of antenna elements; combining phase tapered signals at each corresponding antenna element; adjusting a phase of the combined phase tapered signals upon the occurrence of a predetermined condition; and adjusting a gain of the combined phase tapered signals to (optionally) equalize the amplitude of the output signals of all the antenna elements (or to generate a calculated amplitude taper across the array to alter the beam pattern; i.e., for sidelobe reduction).

A first phase taper value is $2\times m\alpha$, wherein m is the row number in which the antenna element is disposed, the number having a value $\geq 1$ and $\leq M$, and $\alpha=Kd_x \sin(\theta) \cos(\varphi)$; a second phase taper value is $2\times n\beta$, wherein n is the column number in which the antenna element is disposed, the number having a value $\geq 1$ and $\leq N$, and $\beta=Kd_y \sin(\theta) \sin(\varphi)$;

$$K = \frac{2\pi}{\lambda},$$

wherein $\lambda$ is a wavelength; $d_x$ is antenna element spacing in the row direction; and $d_y$ is antenna element spacing in the column direction.

The predetermined condition may occur when $\cos(\omega t+(m\alpha+n\beta))$ and $(\cos(\omega t+2m\alpha)+\cos(\omega t+2n\beta))$ are substantially 180 degrees out of phase with each other, wherein t is time variance and $\omega$ is the frequency of an RF signal. Thus, a phase inversion ($\pi$ radians phase shift) needs to be applied to the signal when this condition occurs, so that the resulting output signal is in phase with the intended resultant output signal which is $\cos(\omega t+(m\alpha+n\beta))$.

These and other aspects of the embodiments herein will be better appreciated and understood when considered in conjunction with the following description and the accompanying drawings. It should be understood, however, that the following descriptions, while indicating preferred embodiments and numerous specific details thereof, are given by way of illustration and not of limitation. Many changes and modifications may be made within the scope of the embodiments herein without departing from the spirit thereof, and the embodiments herein include all such modifications.

BRIEF DESCRIPTION OF THE DRAWINGS

The embodiments herein will be better understood from the following detailed description with reference to the drawings, in which.

DETAILED DESCRIPTION OF THE INVENTION

Figure 1:
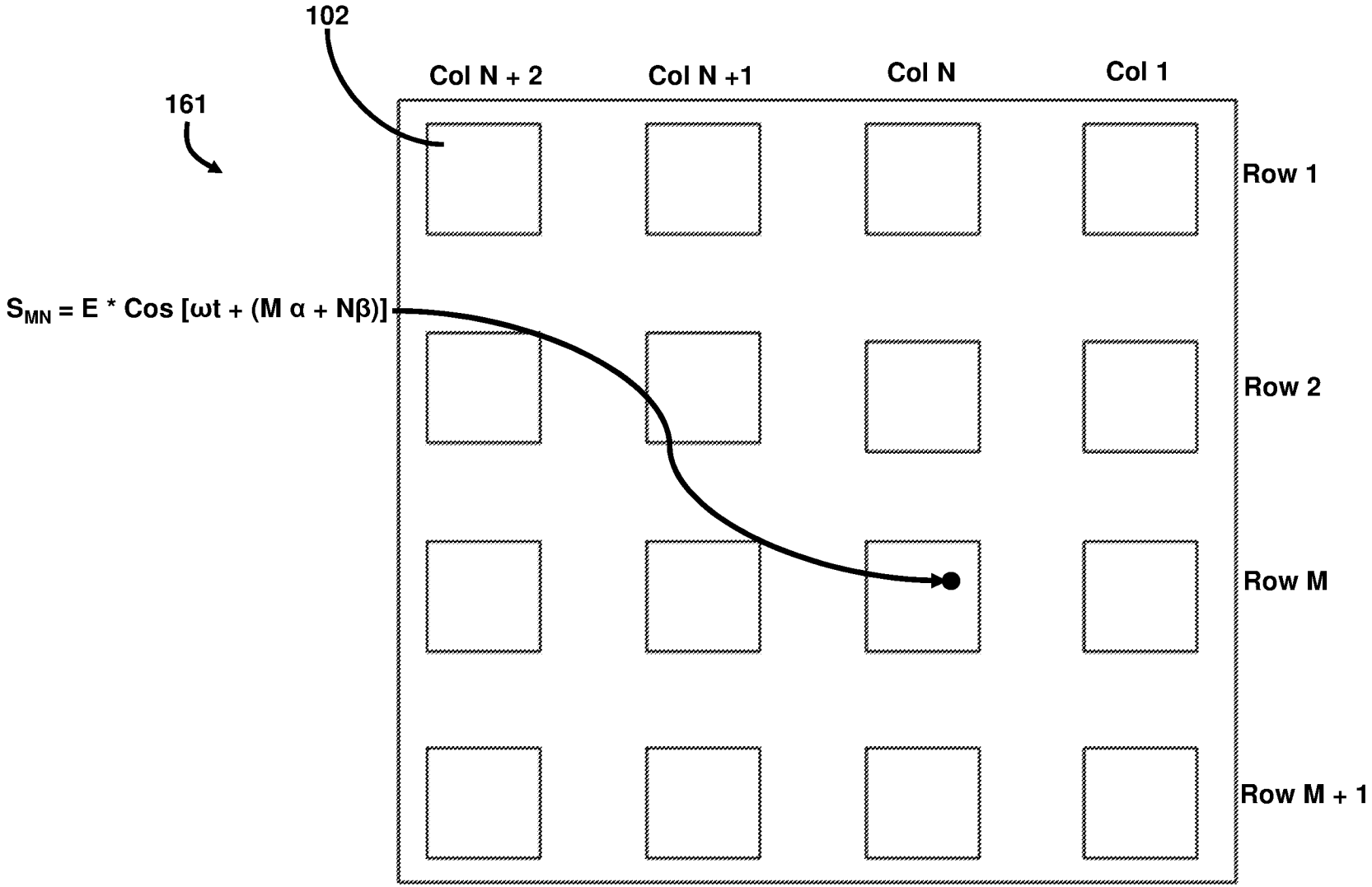
FIG. 1 is a schematic diagram illustrating a signal applied to an element in a traditional 2-D phased array antenna wherein a separate phase shifted signal is calculated for and applied separately to each antenna element in the array, according to an example.

Embodiments of the disclosed invention, its various features and the advantageous details thereof, are explained more fully with reference to the non-limiting embodiments that are illustrated in the accompanying drawings and detailed in the following description. Descriptions of well-known components and processing techniques are omitted to not unnecessarily obscure what is being disclosed. Examples may be provided and when so provided are intended merely to facilitate an understanding of the ways in which the invention may be practiced and to further enable those of skill in the art to practice its various embodiments. Accordingly, examples should not be construed as limiting the scope of what is disclosed and otherwise claimed.

In the drawings, the size and relative sizes of layers and regions may be exaggerated for clarity. The embodiments herein provide a phased array antenna comprising a moderate to large number of antenna elements. The antenna would primarily be used for high RF frequency, high element count (e.g., 100 patch radiators or more) planar array antenna configurations. The embodiments herein reduce the required number of beamformer components (e.g., phase shifters or true time delay modules) from one per antenna element to a number equal to the sum of the number of rows (M) and columns (N) in the array, without loss of beamsteering control of the antenna system. Referring now to the drawings, and more particularly to FIGS. 1 through 10, where similar reference characters denote corresponding features consistently throughout, there are shown exemplary embodiments. While both the transmit and receive functions of the embodiments herein rely on the same mathematical principle of signal summation and have a similar architecture, the following description refers essentially to the transmitter configuration and operation, for ease of explanation.

Considering first a traditional phased array architecture, as provided in FIG. 1, comprising M rows and N columns of equally spaced (e.g., within each set of rows and columns) antenna elements 102, beam steering is accomplished via the distribution of the signal desired to be transmitted (e.g., as a single input arriving from the radio source) across an appropriate corporate (e.g., parallel) or series feed network so that it is split into separate signals of essentially equal amplitude which all arrive in phase at their corresponding antenna elements. In order to accomplish electronic beam steering, each signal first enters a beamformer (e.g., phase shifter or time delay component) which imposes a phase shift/delay on the signal before it is fed into the antenna element and radiated into free space. Due to RF losses in feed lines and beamformers, amplifiers are also optionally included along the signal paths, or directly after each beamformer to assure that the required to total signal power is delivered by the antenna. Phase shift/delay settings are individually applied via control lines distributed to each beamformer. A process similar to all of the above is used for the receive function, just in reverse.

The formulas (in spherical coordinates) for calculating the appropriate phase shift to be applied by each beamformer in the array are as follows:

The phase tapers are calculated for each x, y (row, column) axis of the 2-D (i.e., planar) antenna array 161 of FIG. 1 as $$\alpha = \frac{2\pi}{\lambda} d_x \sin(\theta)\cos(\varphi),$$

$$\beta = \frac{2\pi}{\lambda} d_y \sin(\theta)\sin(\varphi),$$

and as such are a function of the desired spherical coordinate pointing angle ($\theta$, $\varphi$). Beamsteering is achieved by applying a phase shift to each beamformer which is equal to the sum of the incrementally progressive phase shift value associated with the row and column position of the beamformer. Thus, the phase shift applied to the antenna element at the x, y coordinate location M, N is $M\alpha+N\beta$. Consequently, the RF signal radiated by antenna element M, N is $S_{MN}=E*\mathrm{Cos}[\omega t+(M\alpha+N\beta)]$.

The architecture shown in FIG. 1 requires a separate RF circuit and phase control componentry for each antenna element of the array. This is suitable for very small arrays, but practical implementations, particularly for satellite communications in the multi-gigahertz spectrum (i.e., Ka band at 20 GHz to 30 GHz) typically require several hundred to thousands of antenna elements. At this point, the design becomes very expensive due to the number of required beamformer components, and creates the need for very complex packaging, which increases the antenna size and profile, generates additional problems such as thermal issues, and further increases fabrication costs. Accordingly, the embodiments herein overcome these issues using a novel architecture by which full beamsteering control may be accomplished via the use of beamformers at the row and column level only. This reduces the total number of beamformers required from N×M to only N+M.

Figure 2:
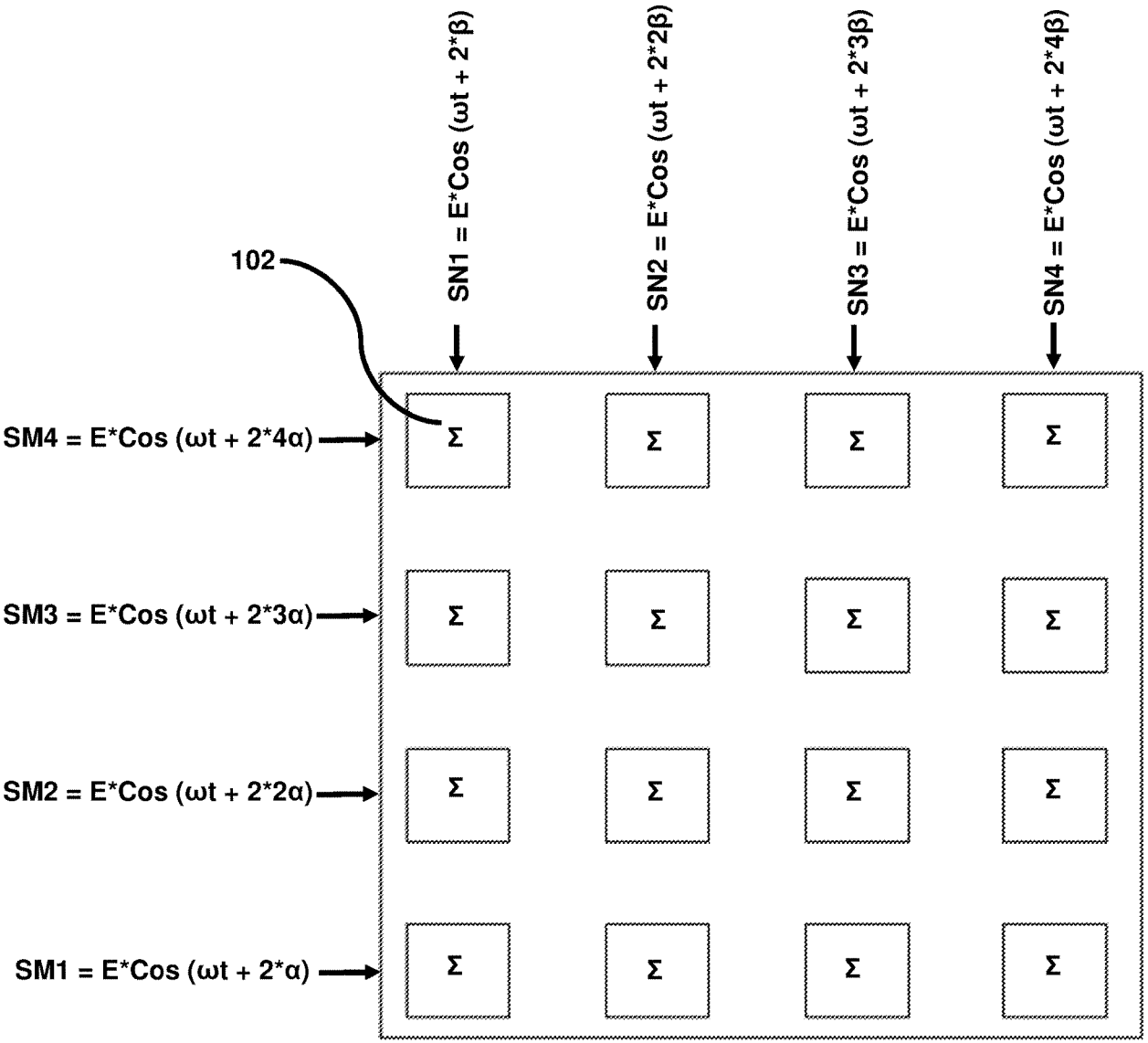
FIG. 2 is a schematic diagram illustrating a beam steering technique using signals with applied row and column phase tapers which are then summed at each corresponding antenna element, according to an example.

One assumption according to the embodiments herein is that there is a way to apply the phase-shifted signals $S_M=E*\mathrm{Cos}[\omega t+(M\alpha)]$ and $S_N=E*\mathrm{Cos}[\omega t+(N\beta)]$ to each corresponding row and column of array elements, and create the desired transmitted signal via RF summation of each corresponding row and column signal at the antenna element 102 level, shown in FIG. 2.

It can be demonstrated that this is possible via the following mathematical relationships; thus, considering the trigonometric identity for the sum of two cosines using the above symbols for amplitude and phase:

$$E*\mathrm{Cos}(\omega t+M\alpha)+E*\mathrm{Cos}(\omega t+N\beta)=\sqrt{2E^2[1+\cos(M\alpha)\cos(N\beta)+\sin(M\alpha)\sin(N\beta)]}*\mathrm{Cos}\left\{\omega t+\tan^{-1}\left[\frac{\sin(M\alpha)+\sin(N\beta)}{\cos(M\alpha)+\cos(N\beta)}\right]\right\}.$$

It can be proven that the phase offset term $$\tan^{-1}\left[\frac{\sin(M\alpha)+\sin(N\beta)}{\cos(M\alpha)+\cos(N\beta)}\right]$$

of the above is equal to the quantity $$\pm\left[\frac{M\alpha+N\beta}{2}\right].$$

Therefore, it can be seen that the sum of the above two row and column cosine functions can produce a signal at a given antenna element 102 that has the same essential form of the signal $S_{MN}$=E*Cos[ωt+(Mα+Nβ)] being applied individually to each antenna element as in the architecture of FIG. 1. Thus, the resultant sum of the row and column signals $S_M$=E*Cos[ωt+(2Mα)] and $S_N$=E*Cos[ωt+(2Nβ)] combined at a given antenna element 102 in the $MN^{th}$ position in the array produces a radiated output of:

$$S_{MN}=\pm\sqrt{2E^2[1+\cos(M\alpha)\cos(N\beta)+\sin(M\alpha)\sin(N\beta)]}*\mathrm{Cos}[\omega t+(M\alpha+N\beta)]$$

With the exception of a possible sign change (phase inversion), and an amplitude which varies between different antenna elements 102, it can be seen that the resultant waveform is Cos[ωt+(Mα+Nβ)]. Now, all that is needed to duplicate the remaining parameters of the output signals is to correct for the amplitude so that the amplitudes out of each of the antenna elements 102 are equal, and to induce a phase inversion at the antenna elements where it is determined that the traditionally produced waveform and the waveform produced by the embodiments herein are 180 degrees out of phase. The amplitude correction may be accomplished by a variable gain amplifier (either analog or digitally controlled) 118 at each of the antenna elements 102, as described with reference to FIG. 3. The gain correction factor is calculated by the antenna system controller as:

$$\frac{1}{\sqrt{2A^2[1+\cos(M\alpha)\cos(N\beta)+\sin(M\alpha)\sin(N\beta)]}}$$

The phase inversion correction is accomplished by switching in a phase adjustor element 110 to create a 180 degree (or zero degrees when not switched in) phase shift or time delay so that the resulting signal is in phase with the signal that would normally have been calculated to be applied to the antenna radiating element 102 using the traditional phased array antenna architecture. The decision of whether or not to switch in the 180 degree phase delay is generated by the antenna system controller using the following calculation: cos[ωt+(Mα+Nβ)], whereby the signal is applied to an antenna element in a traditional architecture, and cos(ωt+2Mα)+cos(ωt+2Nβ), and whereby the signal is applied to row M and column N in the architecture in accordance with the embodiments herein. Thus, it is switched in if the above are 180 degrees out of phase; otherwise, it is not switched.

Figure 3:
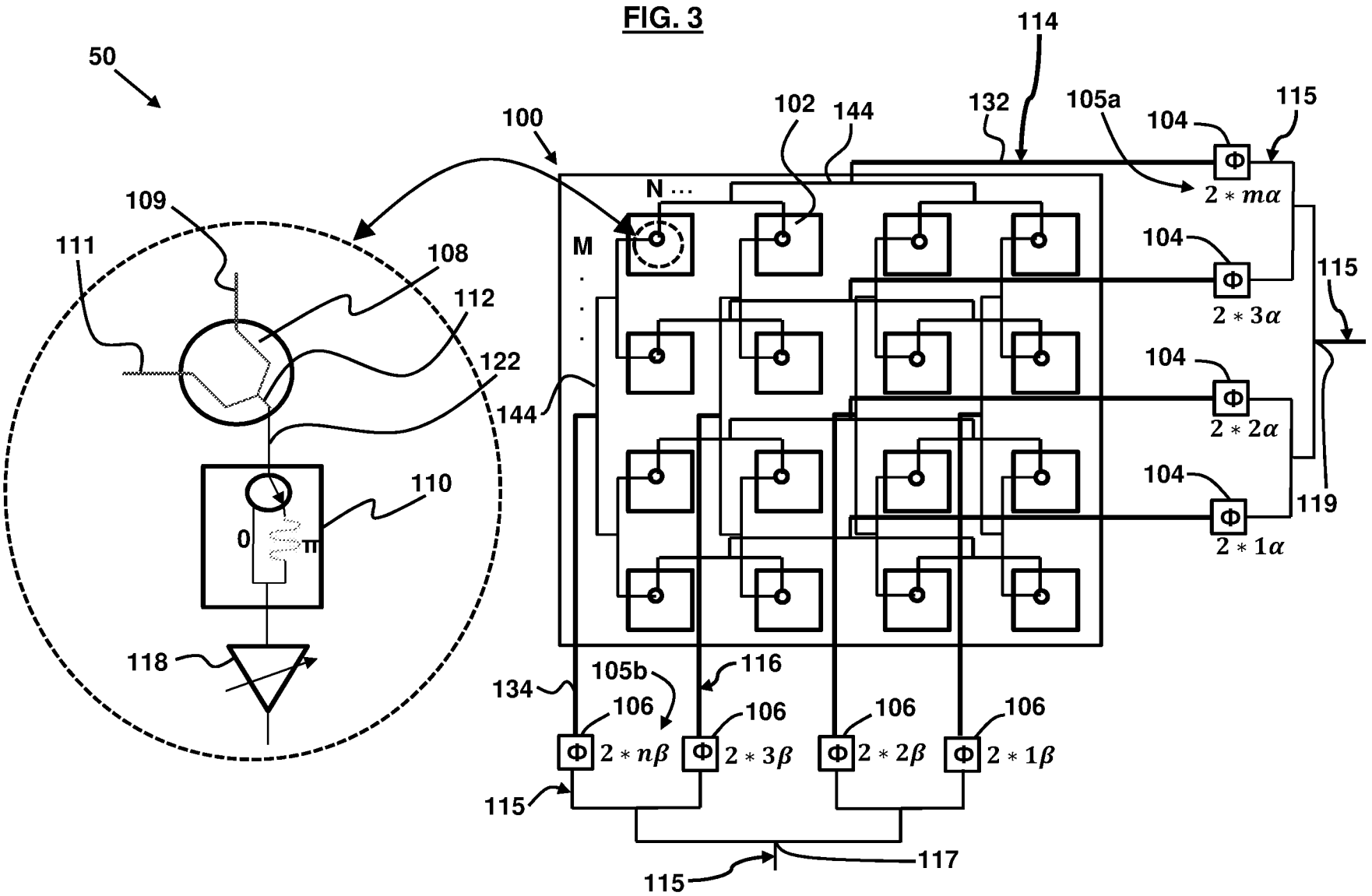
FIG. 3 is a schematic diagram illustrating an apparatus for a steerable phased array antenna, according to an example.

Considering the above, FIG. 3, with reference to FIGS. 1 and 2, illustrates an apparatus 50 for a steerable phased array antenna 100 comprises a plurality of antenna elements 102 disposed in a predetermined number of rows, M, and a predetermined number of columns, N, wherein M and N are positive integers. In an example, the array antenna 100 comprises a set of multiple connected antenna elements 102 working together as a single antenna to transmit radio waves. The apparatus 50 also includes a M number of first beamformer components 104 imposing phase tapers 105*a* upon RF signals travelling through the beamformers. Each first beamformer component 104 corresponds to a row M of antenna elements 102. Moreover, each first beamformer component 104 is operatively connected to the N number of antenna elements 102 in the corresponding row M. The apparatus 50 also comprises a N number of second beamformer components 106 imposing phase tapers 105*b* upon RF signals travelling through the beamformers, wherein each second beamformer component 106 corresponds to a column N of antenna elements 102, and wherein each second beamformer component 106 is operatively connected to the M number of antenna elements 102 in the corresponding column N. In an example, the first and second beamformer components 104, 106 may be traditional MMIC phase shifters. In accordance with the embodiments herein, beamforming may be performed using signal processing techniques.

According to an example, each of the antenna elements 102 comprise a plurality of combiners 108 (e.g., 3 dB Wilkinson combiners, for example) each having a first input 109, a second input 111, and an output 112. Each input 109, 111 is operatively connected to a corresponding beamformer component 104, 106 so as to combine a first phase tapered RF signal 114 from the first beamformer component 104 corresponding to the row M of the corresponding antenna element 102 with a second phase tapered RF signal 116 from the second beamformer component 106 corresponding to the column N of the corresponding antenna element 102.

Each of the antenna elements 102 also comprise a phase adjustor element 110 to selectively switch in a 0 degree or 180 degree phase shift or phase delay to an RF signal output 112 from a combiner 108. Each of the antenna elements 102 further comprise a variable gain amplifier 118 to adjust the amplitude of the RF signal outputs 112 so that they are all of equal amplitude going into the radiating patch (front end) of each antenna element 102 before being radiated into free space. The variable gain amplifier 118 may not necessarily be required since reasonably good beam quality may result in spite of the nonuniformity in signal amplitudes radiated by each antenna element 102, mostly likely due to the somewhat random distribution and overall lack of extreme variability between these signal amplitudes. A controller 204, such as the one shown in FIG. 9, may be operably connected to each of the beamformer components 104, 106, the variable gain amplifier 118, and the phase adjustor element 110 to generate the phase tapers 105*a*, 105*b*, as well as set variable RF signal amplitudes and switch in (0 or180 degree) phase delays, as needed for each of the antenna elements 102 associated with any commanded pointing angle (θ, φ). In an example, the controller 204 may be any type of processor, microcontroller, application specific processor, application specific integrated circuit, or digital signal processor. A phase adjustor phase of the phase adjustor element 110 may be selectable to either 0 or π radians, according to an example. According to some examples, the beamformer components 104, 106 may comprise one of either a traditional MMIC phase shifter or switchable delay line module of the appropriate resolution; typically 4 to 8 bits (16 to 256 states). The outline of the antenna element 102 in its simplest form comprises a continuous electrically conductive patch that, combined with an underlying adjacent dielectric layer, followed by a conformal ground plane layer forms the component that radiates RF energy into free space. The source of that RF energy is the output of the phase adjustor component 110 or the VGA 118 (if included), with an electrically conductive connection being made from the output to the conductive radiating patch surface of the antenna element 102 at an appropriate point on the surface area of 102 to efficiently couple the RF energy into free space and at the correct desired polarization. The dimension of each side of the patch perimeter should be ideally be about ½ the wavelength of the RF signal to be radiated. In the drawings, the square outline denoting the antenna element 102 constitutes the radiating metallic patch itself. The combiners 108, phase adjustor element 110, and the variable gain amplifier 118 shown in the expanded view are components that are configured to have a smaller size than the footprint of the antenna element 102, and are attached to the back (e.g., non-radiating) side of the radiating antenna element 102.

According to an example, a first phase taper 105*a* applied to signal 115 entering a first beamformer component 104 is 2×mα, and a second phase taper 105*b* likewise being applied to the same signal 115 entering a second beamformer component 106 is 2×nβ, wherein m is the row number of the corresponding antenna element 102 that is ≥1 and ≤M, n is the column number of the corresponding antenna element 102 that is ≥1 and ≤N, $\alpha = Kd_x \sin(\theta)\cos(\varphi)$, $= Kd_y \sin(\theta)\sin(\varphi)$, $$K = \frac{2\pi}{\lambda},$$

λ is wavelength, $d_x$ is antenna element spacing in the row direction, $d_y$ is antenna element spacing in the column direction, and (θ, φ) is the spherical coordinate pointing angle of the steerable phased array antenna 100. In an example, $d_x = d_y = \lambda/2$. Signal 115 is the signal of origin (e.g., the actual information-bearing signal from the communication source) to be transmitted through the antenna, and as such has been split into identical signals of equal amplitude and fed in-phase to the row side input point 119 and column side input point 117.

In an example, the phase adjustor element 110 is configured to add a π radians phase delay to the RF signal 122 from the combiner 108 when cos(ωt+(mα+nβ)) and (cos(ωt+2mα)+cos(ωt+2nβ)) are substantially 180 degrees out of phase with each other, wherein t is time variance and ω is the frequency of the RF signal 122.

The apparatus 50 may comprise a plurality of first signal paths 132 operatively connecting the first beamformer components 104 to the antenna elements 102 in the corresponding row M by equal path lengths. The antenna 100 may further comprise a plurality of second signal paths 134 operatively connecting the second beamformer components 106 to the antenna elements 102 in the corresponding column N by equal path lengths. In an example, the signal paths 132, 134 comprise conductive traces (e.g., RF transmission lines) 144.

Figure 4A:
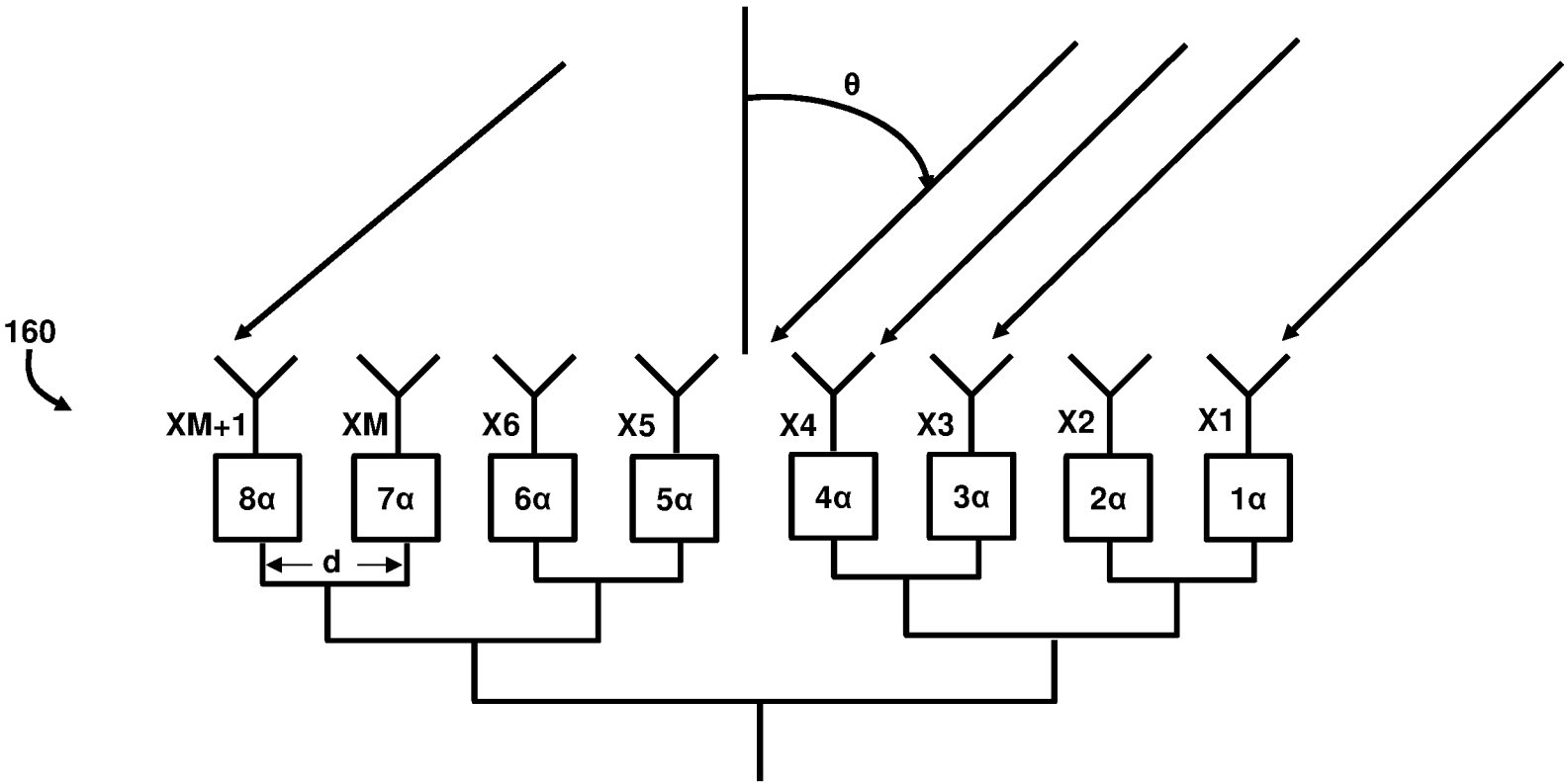
FIG. 4A is a schematic diagram illustrating a 1-D phased array antenna, according to an example.
Figure 4B:
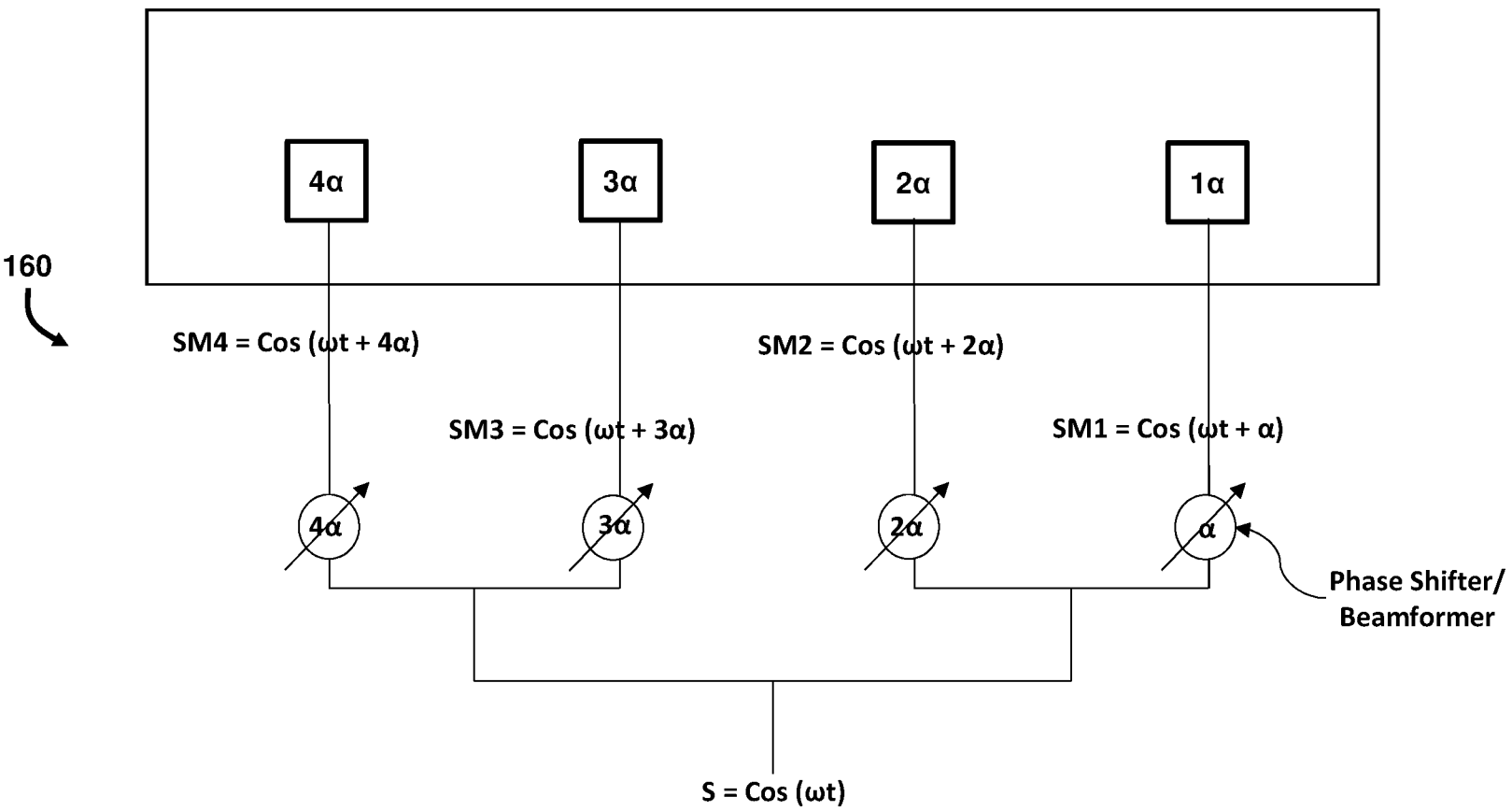
FIG. 4B is a schematic diagram illustrating linear array beam steering, according to an example.

As shown in FIGS. 4A and 4B, for a linear array 160 of equally spaced, uniformly fed antenna elements 102 of FIGS. 1 through 3, a progressive phase shift of α=

$$\alpha = \frac{2\pi}{\lambda} d \sin(\theta)$$

is applied to each successive element 102 to steer a beam to θ degrees off boresight. Thus, the first element from one end of the array 160 is delayed by α, the second by 2α, and so on.

Extending this to a planar (N×M) array, as shown in FIG. 3, it may be shown that similarly for a two-axis beam steering array 100, at the angle pair (θ, φ), the phase delay applied to the $MN^{th}$ element 102 is Mα+Nβ, where the two phase shift terms are respectively defined as:

$$\alpha = \frac{2\pi}{\lambda} d_x \sin(\theta)\cos(\varphi),$$

$$\beta = \frac{2\pi}{\lambda} d_y \sin(\theta)\sin(\varphi).$$

Hence, this value is the sum of the individual delays that would be applied to the $M^{th}$ or $N^{th}$ element 102 in a linear array 160 of a single row M or column N of the planar antenna array 161 of FIG. 1 to produce a single axis beam steering angle of θ degrees. Thus, according to FIG. 3, by applying a phase delay to only one axis of the array 100, the beam may be steered to a non-zero (e.g., the 0, 0 angle pair being boresight) angle along only one axis of the array 100. Thus, each row M or column N of the array 100 may be treated as a single element 102 along that axis, with the constant phase delay added cumulatively to every element 102 in each row M or column N. The signals applied to each row M and column N, although not shown to simplify the drawing, travel an equal distance to every element 102 in each row M or column N, in order to maintain a proper phase relationship. Accordingly, one may control two-axis steering of the array antenna 100 by treating each row M and column N as single antenna elements 102, and cumulatively applying a fixed delay associated with the steering angle required for axis to each respective row M and column N in the array 100. Thus, only M+N phase shifters (e.g., beamforming components 104, 106) are required to control the array antenna 100.

To further illustrate, in the spherical coordinate system, it can be seen that the phase taper 105*a*, 105*b* for each axis is very similar in form to the formula for the phase taper for a linear array, and that the expression for each axis reduces to the formula for a single axis when the angle ω is either 0 or 90 degrees. Therefore, the 2-D antenna steering angle reduces to θ, with:

$$\alpha=\pi \sin(\theta)\cos(\varphi)=\pi \sin(\theta) \text{ for } \varphi=0$$

$$\beta=\pi \sin(\theta)\sin(\varphi)=0 \text{ for } \varphi=0$$

$$\beta=\pi \sin(\theta)\sin(\varphi)=\pi \sin(\theta) \text{ for } \varphi=\pi/2$$

$$\alpha=\pi \sin(\theta)\cos(\varphi)=0 \text{ for } \varphi=\pi/2.$$

Knowing that the phase delay applied to each array element 102 is calculated as a value very closely resembling the sum of the incrementally increasing integral multiples of the individual phase taper 105*a*, 105*b* for each axis, the RF signal applied to each array element 102 is of the form:

$$S_{MN}=E^*\cos[\omega t+(M\alpha+N\beta)].$$

Figure 5:
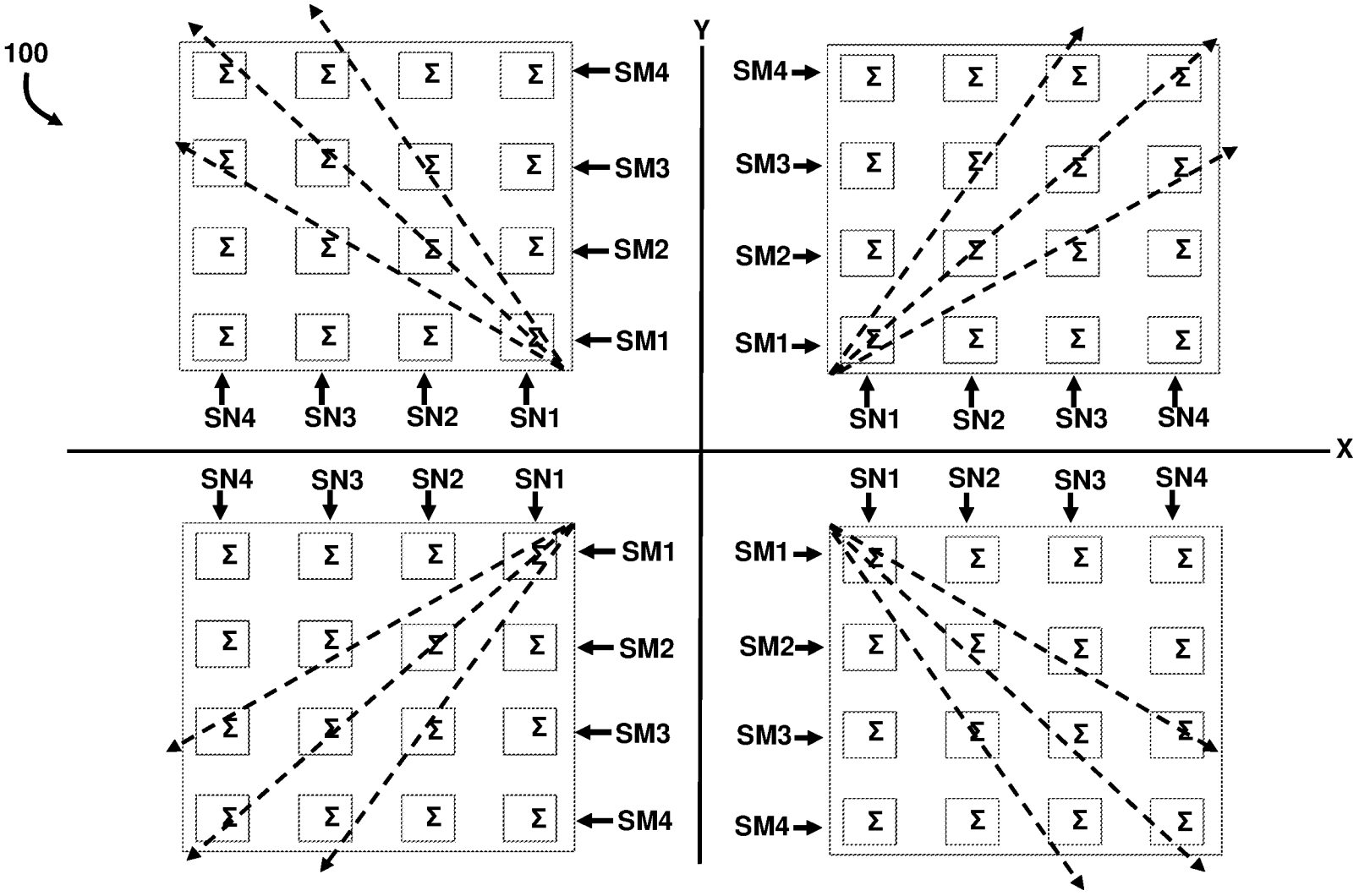
FIG. 5 is a schematic diagram illustrating beam steering in each of the four quadrants, according to an example.
Figure 6:
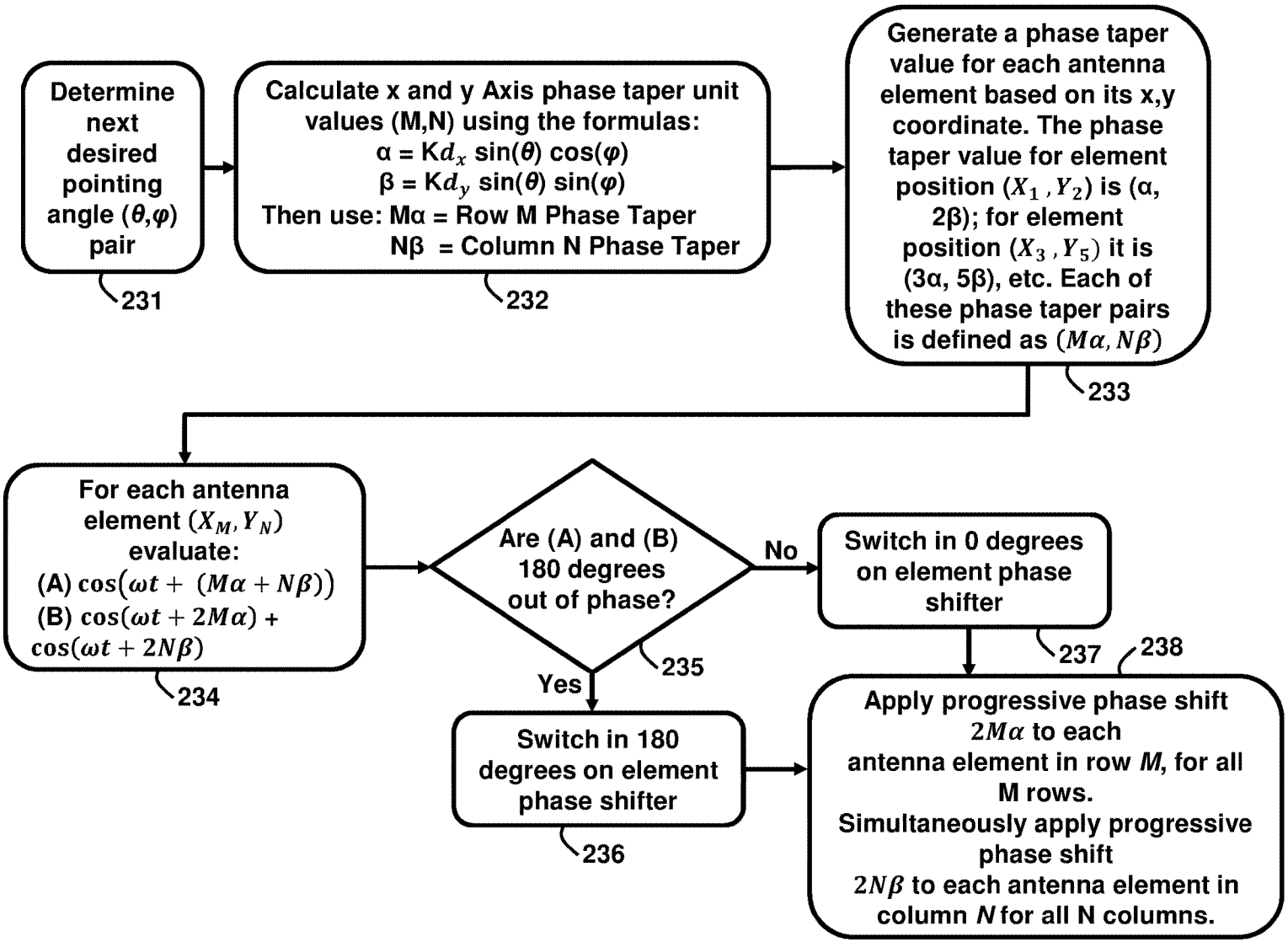
FIG. 6 is a flow diagram illustrating a pointing process to determine a phase term, according to an example.
Figure 7:
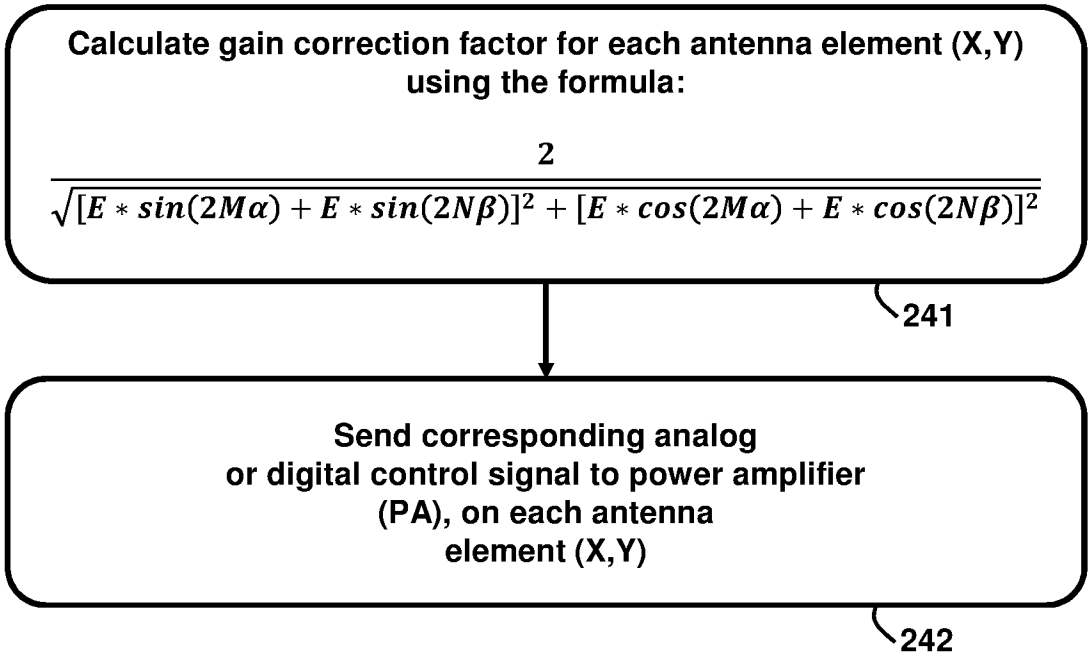
FIG. 7 is a flow diagram illustrating a pointing process to determine an amplitude term, according to an example.

An overall antenna pointing and control algorithm is shown in FIGS. 6 and 7, with reference to FIGS. 1 through 5, for adjusting the phase of the row and column input signals (for transmit in this case) and for switching in (when needed) the 180 degree (π radians) phase shift/delay and gain setting on the amplifiers at each antenna element 102. This cycle is repeated as often as needed to keep the RF beam pointed in a desired direction, at a rate of about 10 to 20 times per second for a communications-on-the-move application. FIG. 5 further illustrates the directions of progression of the phase tapers along each axis for each of the possible 4 quadrants in the spherical coordinate system. In block 231, the next desired pointing angle pair (θ, φ) is determined.

Next, in block 232, it may be assumed that the phase taper 105*a*, 105*b* for the x and y axis as a function of the pointing angle pair (θ, φ) in spherical coordinates is:

$$\alpha=Kd_x \sin(\theta)\cos(\varphi)$$

$$\beta=Kd_y \sin(\theta)\sin(\varphi).$$

Since $$K=\frac{2\pi}{\lambda}$$

and $d_x$ and $d_y$ are each equal to λ/2, to eliminate grating lobes, $$\alpha=\pi \sin(\theta)\cos(\varphi)$$

$$\beta=\pi \sin(\theta)\sin(\varphi).$$

Therefore, for a conical sweep (θ) range of 0 to 70 degrees, α and β may vary from about 0 to 3 (in radians). In block 233, a phase taper value is generated for each antenna element 102 based on its x, y coordinate. For each antenna element ($X_M$, $Y_N$), as shown in block 234, the following are evaluated:

$$\cos[\omega t+(M\alpha+N\beta)]$$

$$\cos(\omega t+2M\alpha)+\cos(\omega t+2N\beta).$$

In decision block 235, it is determined whether (A) and (B) are 180 degrees out of phase, and if so (Yes), then there is a phase shift of 180 degrees using the adjustor element 110, in block 236. If (A) and (B) are not 180 degrees out of phase (No), then there is no phase shift, as indicated in block 237. After either block 236 or block 237, the process moves to block 238 and applies a progressive phase shift 2Mα to each antenna element 102 in row M, for all M rows, and simultaneously applies a progressive phase shift 2N/β to each antenna element 102 in column N for all N columns.

As for the amplitude, with the exception of very small pointing angles off antenna boresight (θ), the amplitude of the summed cosines at a given antenna element 102 will vary in a somewhat complex manner from element to element, where:

$$\text{Gain}=\frac{2}{\sqrt{[E*\sin(2M\alpha)+E*\sin(2N\beta)]^2+[E*\cos(2M\alpha)+E*\cos(2N\beta)]^2}}.$$

The gain correction factor for each antenna element (X, Y) may be calculated based on the above formula, as provided in block 241. In order to maintain a constant amplitude level across the array 100, as indicated in block 242, a variable gain amplifier 118 (i.e., surface mount power amplifier (PA) chip) may be used, and as shown in FIG. 3, so that the signal amplitudes at each antenna element 102 are close to equal to each other. Also, this gain could be made constant or zero across the array if the resulting beam pattern (i.e., sidelobe levels) is acceptable for the given application, or a custom gain distribution could be applied across the array to alter the beam shape (i.e., minimize sidelobes) to meet some other specification.

These amplifiers 118 are phase invariant so as not to create an additional phase shift in the signal with changes in gain. They may also have a gain range from about 0 to 15 dB. The required gain (dB) is calculated as:

$$10 \log(2/E).$$

Along with the phase information calculated for the row M and column N beamformer components 104, 106 (and potential phase inversion at each antenna element 102), these gain values are calculated and delivered to each antenna element 102 for each new pointing angle (θ, φ) as the beam is being steered.

Figure 8:
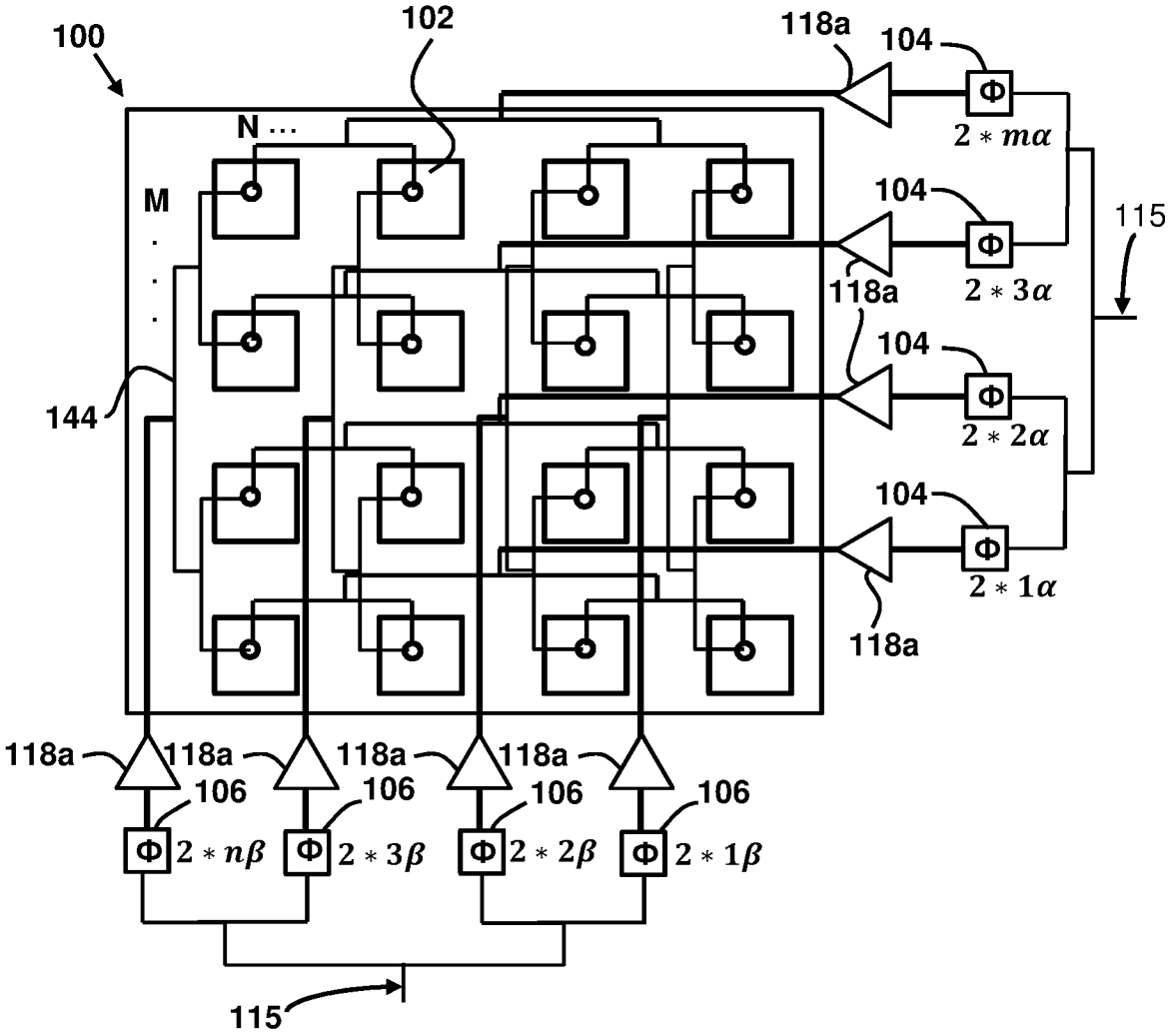
FIG. 8 is a schematic diagram illustrating a steerable phased array antenna, according to an example.

It may further be seen that amplifiers 118*a* may be placed at the row and column level, (as shown in FIG. 8, with reference to FIGS. 1 through 7) for the purpose of boosting the signal levels so that further amplification (to achieve the total desired beam output power) is not needed at the antenna element 102 level. This may eliminate the need for amplifiers 118 at the antenna element level, and therefore reduce the overall cost and complexity of the antenna 100. However, considering the mathematical relationships involved with the summation of the row and column signals, it is desired that amplitudes of the signals entering each input (109, 111) to the combiners (at each element 102) are as close as possible to equal, since any difference in their amplitudes will cause a resultant phase error in the signal at the combiner output 112. Therefore, it may be desired to implement variable gain amplifiers (VGAs) for each amplifier 118*a*, and use closed loop control to make all of the outputs of the amplifiers 118*a* equal to each other.

Figure 9:
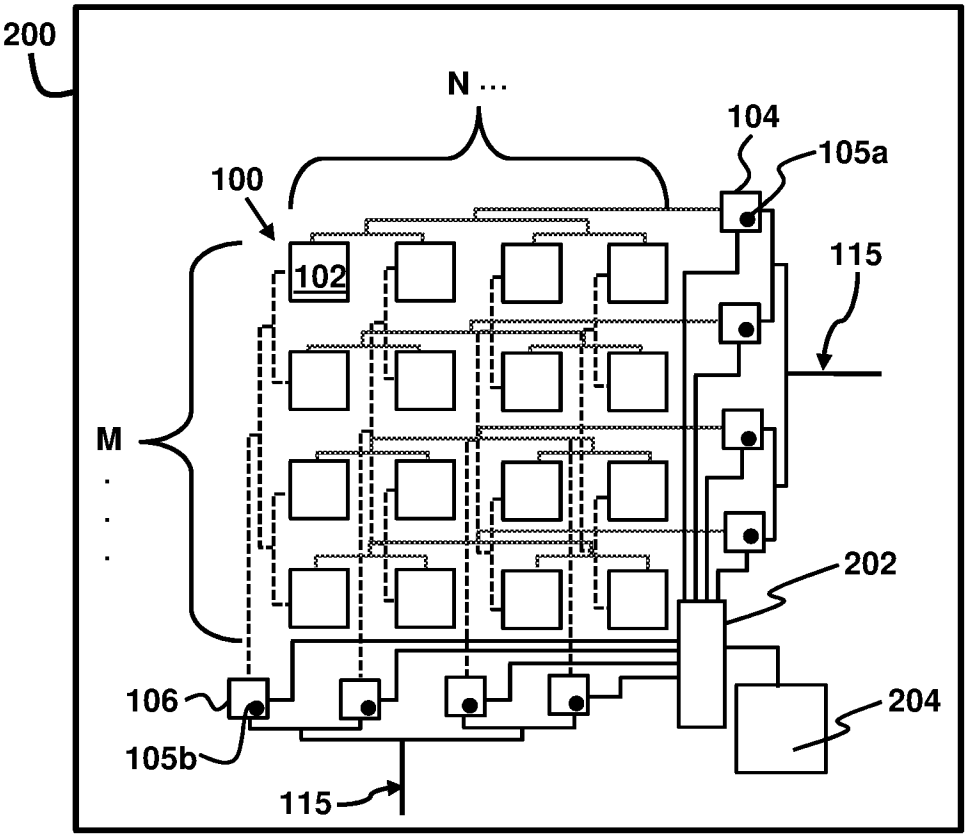
FIG. 9 is a schematic diagram illustrating a system, according to an example.

As shown in FIG. 9, with reference to FIGS. 1 through 8, a system 200 comprises a steerable phased array antenna 100, a signal processor 202, and a controller 204 therefor, wherein the steerable phased array antenna 100 comprises a plurality of antenna elements 102 disposed in a predetermined number of rows, M, and a predetermined number of columns, N, wherein M and N are positive integers. The antenna 100 further comprises a M number of first beamformer components 104 comprising phase tapers 105*a*, wherein each first beamformer component 104 corresponds to a row M of antenna elements 102, and wherein each first beamformer component 104 is operatively connected to the N number of antenna elements 102 in the corresponding row M. The antenna 100 also includes a N number of second beamformer components 106 comprising phase tapers 105*b*, wherein each second beamformer component 106 corresponds to a column N of antenna elements 102, and wherein each second beamformer component 106 is operatively connected to the M number of antenna elements 102 in the corresponding column N.

Again with reference to FIG. 3, each of the antenna elements 102 comprise a plurality of combiners 108 each having a first input 109, a second input 111, and an output 112, wherein each input 109, 111 being operatively connected to a corresponding beamformer component 104, 106 and configured to combine a first phase tapered RF signal 114 from the first beamformer component 104 corresponding to a row M of a corresponding antenna element 102 with a second phase tapered RF signal 116 from the second beamformer component 106 corresponding to a column N of a corresponding antenna element 102.

Moreover, each of the antenna elements 102 comprise a variable gain amplifier 118 to adjust the amplitude of a RF signal 122, an antenna radiating surface on 102 for radiating the RF signal 122 into free space, and a phase adjustor element 110 to add a $\pi$ radian phase delay to an RF signal 122 from a combiner 108 when $\cos(\omega t+(m\alpha+n\beta))$ and $(\cos(\omega t+2a)+\cos(\omega t+2\beta))$ are substantially 180 degrees out of phase with each other, wherein t is time variance and $\omega$ is the frequency of the RF signal.

According to an example, a phase taper 105*a* applied to the first beamformer component 104 is $2\times m\alpha$; the phase taper 105*b* applied to the second beamformer component 106 is $2\times n\beta$; m is the row number of a corresponding antenna element 102 that is $\geq 1$ and $\leq M$; n is the column number of the corresponding antenna element 102 that is $\geq 1$ and $\leq N$; $\alpha=Kd_x \sin(\theta)\cos(\varphi)$; $\beta=Kd_y \sin(\theta)\sin(\varphi)$;

$$K = \frac{2\pi}{\lambda},$$

$\lambda$ is wavelength of the RF signal; $d_x$ is antenna element spacing in the row direction; $d_y$ is antenna element spacing in the column direction; and $(\theta, \varphi)$ is the spherical coordinate pointing angle of the steerable phased array antenna 100. The controller 204, being responsive to commands to steer the steerable phased array antenna 100, receives the pointing angle $(\theta, \varphi)$ and generates phase taper values (from phase tapers 105*a*, 105*b*) to be applied to the beamformer components 104, 106. Moreover, in an example, $d_x=d_y=\lambda/2$. A phase corrector phase is selectable to either 0 or $\pi$ radians.

In an example, the beamformer components 104, 106 comprise one of either a phase shifter, a true time delay module (comprised of any number of technologies known to anyone skilled in the art), either typically having a 4 to 8 bit resolution providing for a corresponding 16 to 256 different phase or time delay states. The system 200 may comprise a plurality of first signal paths 132 operatively connecting the first beamformer component 104 to the antenna elements 102 in the corresponding row M by equal path lengths, and a plurality of second signal paths 134 operatively connecting the second beamformer components 106 to the antenna elements 102 in the corresponding column N by equal path lengths. The plurality of first and the second signal paths 132, 134 comprise a plurality of conductive traces 144, according to an example. The variable gain amplifier 118 may comprise a phase invariant variable gain function. In an example, an M+N number of first and second beamformer components 104, 106 provide a combined first and second phase tapered RF signals 114, 116 to $M\times N$ number of antenna elements 102 through $M\times N$ number of combiners 108.

Figure 10:
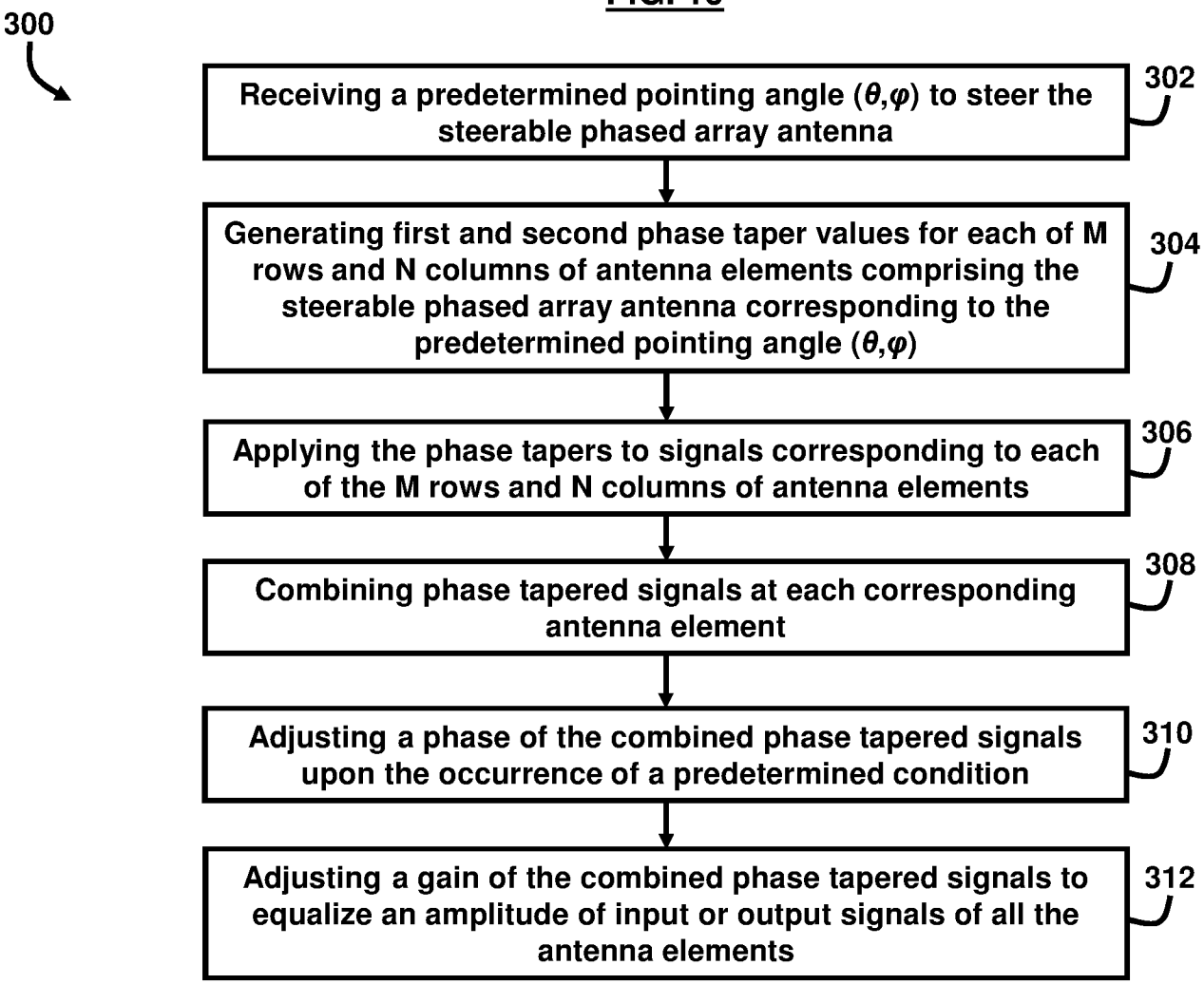
FIG. 10 is a flow diagram illustrating a method, according to an example.

According to another embodiment, in an electronically steerable phased array antenna 100 comprising M rows and N columns of antenna elements 102 and RF signal paths 132, 134 connected thereto, a method 300 is provided in FIG. 10, with reference to FIGS. 1 through 9. The method 300 comprises receiving (302) a predetermined pointing angle $(\theta, \varphi)$ to steer the steerable phased array antenna 100; generating (304) first and second phase taper values for each of M rows and N columns of antenna elements 102 comprising the steerable phased array antenna 100 corresponding to the predetermined pointing angle $(\theta, \varphi)$, wherein M and N are positive integers; applying (306) the phase tapers 105*a*, 105*b* to incoming signals 115 at row and column beamformer components 104, 106; combining (308) phase tapered signals 114, 116 at each corresponding antenna element 102; adjusting (310) a phase of the combined phase tapered signals 114, 116 upon the occurrence of a predetermined condition; and adjusting (312) a gain of the combined phase tapered signals 114, 116 to equalize an amplitude of output signals of all the antenna elements 102.

According to an example, a first phase taper 105*a* has a value of $2\times m\alpha$, wherein m is the row number in which the antenna element 102 is disposed, the number having a value $\geq 1$ and $\leq M$, and $\alpha=Kd_x \sin(\theta)\cos(\varphi)$. According to another example, a second phase taper 105*b* has a value $2\times n\beta$, wherein n is the column number in which the antenna element 102 is disposed, the number having a value $\geq 1$ and $\leq N$, and $\beta=Kd_y \sin(\theta) \sin(\varphi)$. Furthermore, $$K = \frac{2\pi}{\lambda},$$

wherein $\lambda$ is a wavelength; $d_x$ is antenna element spacing in the row direction; and $d_y$ is antenna element spacing in the column direction.

The predetermined condition occurs when $\cos(\omega t+(m\alpha+n\beta))$ and $(\cos(\omega t+2m\alpha)+\cos(\omega t+2n\beta))$ are substantially 180 degrees out of phase with each other, wherein t is time variance and $\omega$ is the frequency of an RF signal 122, according to an example.

The techniques provided by the embodiments herein reduces the cost of manufacturing a phased array antenna because the beamforming hardware and required packaging in the plane of the antenna is typically the most expensive part of antenna manufacturing, and the embodiments herein are able to control the number of beamforming components using the relation $(N+M)/(N\times M)$, which continues to provide a cost advantage as the number of antenna elements in the array increases.

The embodiments herein minimize the number of phase control elements (e.g., beamforming components) in the antenna architecture, and thus reduce the packaging density, complexity, and cost of the manufactured phased array antenna. The embodiments herein may be applied to virtually any phased array antenna system, but is particularly useful for high density planar (e.g., radiating patch elements in a single plane) arrays operating at microwave frequencies (e.g., >1 GHz), and comprised of large numbers of patch elements (e.g., 100 to 1000+).

The foregoing description of the specific embodiments will so fully reveal the general nature of the embodiments herein that others can, by applying current knowledge, readily modify and/or adapt for various applications such specific embodiments without departing from the generic concept, and, therefore, such adaptations and modifications should and are intended to be comprehended within the meaning and range of equivalents of the disclosed embodiments. It is to be understood that the phraseology or terminology employed herein is for the purpose of description and not of limitation. Those skilled in the art will recognize that the embodiments herein can be practiced with modification within the spirit and scope of the appended claims.

What is claimed is:

1. An apparatus for a steerable phased array antenna comprising:

a plurality of antenna elements disposed in a predetermined number of rows, M, and a predetermined number of columns, N, wherein M and N are positive integers;

a M number of first beamformer components comprising phase tapers, wherein each first beamformer component corresponds to a row of antenna elements, and wherein each first beamformer component is operatively connected to the N number of antenna elements in the corresponding row; and a N number of second beamformer components comprising phase tapers, wherein each second beamformer component corresponds to a column of antenna elements, and wherein each second beamformer component is operatively connected to the M number of antenna elements in the corresponding column, wherein each of the antenna elements comprise:

a plurality of combiners each having a first input, a second input, and an output, wherein each input being operatively connected to a corresponding beamformer so as to combine a first phase tapered RF signal from the first beamformer component corresponding to the row of the corresponding antenna element with a second phase tapered RF signal from the second beamformer component corresponding to the column of the corresponding antenna element;

a phase adjustor element to selectively add a phase shift or time delay to an RF signal output from a combiner;

a variable gain amplifier to adjust the amplitude of the RF signal output; and an antenna radiating element to radiate an RF signal into free space.

2. The apparatus of claim 1, wherein a first phase taper corresponding to a first beamformer component is $2\times m\alpha$, and a second phase taper corresponding to a second beamformer component is $2\times n\beta$, wherein m is the row number of the corresponding antenna element $\geq 1$ and $\leq M$, n is the column number of the corresponding antenna element $\geq 1$ and $\leq N$, $\alpha = K\, d_x \sin(\theta)\cos(\varphi)$, $K = 2\pi/\lambda$ is wavelength, $d_x$ is antenna element spacing in the row direction, $d_y$ is antenna element spacing in the column direction, and $(\theta, \varphi)$ is the spherical coordinate pointing angle of the steerable phased array antenna.

3. The apparatus of claim 2, wherein $d_x = d_y = \lambda/2$.

4. The apparatus of claim 1, wherein the phase adjustor element is configured to add a $\pi$ radians phase delay to the RF signal output from the combiner when $\cos(\omega t + (m\alpha + n\beta))$ and $(\cos(\omega t + 2\ m\alpha) + \cos(\omega t + 2n\beta))$ are substantially 180 degrees out of phase with each other, wherein t is time variance and $\omega$ is the frequency of the RF signal output.

5. The apparatus of claim 1, comprising:

a plurality of first signal paths operatively connecting the first beamformer components to the antenna elements in the corresponding row by equal path lengths; and a plurality of second signal paths operatively connecting the second beamformer components to the antenna elements in the corresponding column by equal path lengths.

6. The apparatus of claim 1, wherein an RF signal entering first and second inputs of the combiner are substantially of equal amplitude.

7. The apparatus of claim 1, comprising a controller operably connected to each of the beamformer components, the variable gain amplifier, and the phase adjustor element to generate the phase tapers, a variable RF signal amplitude, and relative RF signal phases associated with each radiating antenna element which correspond to any commanded pointing angle $(\theta, \varphi)$ and beam pattern.

8. The apparatus of claim 7, wherein a phase adjustor phase is selectable to either 0 or $\pi$ radians.

9. The apparatus of claim 5, wherein the plurality of first and the second signal paths comprise a plurality of strip lines or transmission lines.

10. The apparatus of claim 1, comprising a plurality of RF signals derived from a single originating RF signal that has been fed in-phase into each of the first and second beamformer components and subsequently phase shifted or time delayed in the first and second beamformer components by a unique phase taper value applied by an external control mechanism to each of the first and second beamformer components.

11. A system comprising:

a steerable phased array antenna and a controller therefor, wherein the steerable phased array antenna comprises:

a plurality of antenna elements disposed in a predetermined number of rows, M, and a predetermined number of columns, N, wherein M and N are positive integers;

a M number of first beamformer components comprising phase tapers, wherein each first beamformer component corresponds to a row of antenna elements, and wherein each first beamformer component is operatively connected to the N number of antenna elements in the corresponding row; and a N number of second beamformer components comprising phase tapers, wherein each second beamformer component corresponds to a column of antenna elements, and wherein each second beamformer component is operatively connected to the M number of antenna elements in the corresponding column, wherein each of the antenna elements comprise:

a plurality of combiners each having a first input, a second input, and an output, wherein each input being operatively connected to a corresponding beamformer component and configured to combine a first phase tapered RF signal from the first beamformer component corresponding to a row of a corresponding antenna element with a second phase tapered RF signal from the second beamformer component corresponding to a column of a corresponding antenna element;

a variable gain amplifier to adjust the amplitude of an RF signal;

an antenna radiating element for radiating the RF signal into free space; and a phase corrector to add a $\pi$ radian phase delay to the output from a combiner when $\cos(\omega t+(m\alpha+n\beta))$ and $(\cos(\omega t+2\ m\alpha)+\cos(\omega t+2\beta))$ are substantially 180 degrees out of phase with each other, wherein t is time variance and $\omega$ is the frequency of the RF signal, wherein a phase taper applied to the first beamformer component is $2\times m\alpha$, wherein the phase taper applied to the second beamformer component is $2\times n\beta$; m is the row number of a corresponding antenna element $\geq 1$ and $\leq M$; n is the column number of the corresponding antenna element $\geq 1$ and $\leq N$; $\alpha=K\ d_x \sin(\theta)\cos(\varphi)$, $K=2\pi/\lambda$, $\lambda$ is wavelength of the RF signal; $d_x$ is antenna element spacing in the row direction; $d_y$ is antenna element spacing in the column direction; and $(\theta, \varphi)$ is the spherical coordinate pointing angle of the steerable phased array antenna, wherein the controller, being responsive to commands to steer the steerable phased array antenna, receives the pointing angle $(\theta, \varphi)$ and generates phase taper values to be applied to the first and second beamformer components.

12. The system of claim 11, wherein a phase corrector phase is selectable to either 0 or $\pi$ radians.

13. The system of claim 11, comprising:

a plurality of first signal paths operatively connecting the first beamformer components to the antenna elements in the corresponding row by equal path lengths; and a plurality of second signal paths operatively connecting the second beamformer components to the antenna elements in the corresponding column by equal path lengths.

14. The system of claim 13, wherein the plurality of first and the second signal paths comprise a plurality of strip lines or transmission lines.

15. The system of claim 11, wherein the variable gain amplifier comprises a phase invariant variable gain function.

16. The system of claim 11, wherein $d_x=d_y=\lambda/2$.

17. The system of claim 11, wherein an M+N number of first and second beamformer components provide a combined first and second phase tapered RF signals to M×N number of antenna elements through M×N number of combiners.

18. In an electronically steerable phased array antenna comprising rows and columns of antenna elements and RF signal paths connected thereto, a method comprising:

receiving a predetermined pointing angle $(\theta, \varphi)$ to steer the steerable phased array antenna;

generating first and second phase taper values for each of M rows and N columns of antenna elements comprising the steerable phased array antenna corresponding to the predetermined pointing angle $(\theta, \varphi)$, wherein M and N are positive integers;

applying the phase tapers to signals corresponding to each of the M rows and N columns of antenna elements;

combining phase tapered signals at each corresponding antenna element;

adjusting a phase of the combined phase tapered signals upon the occurrence of the predetermined condition that $\cos(\omega t+(m\alpha+n\beta))$ and $(\cos(\omega t+2m\alpha)+\cos(\omega t+2n\beta))$ are substantially 180 degrees out of phase with each other, wherein t is time variance and $\omega$ is RF signal frequency; and adjusting a gain of the combined phase tapered signals to equalize an amplitude of output signals of all the antenna elements.

19. The method of claim 18, wherein:

a first phase taper value is $2\times m\alpha$, wherein m is the row number in which the antenna element is disposed, the number having a value $\geq 1$ and $\leq M$, and $\alpha=K\ d_x \sin(\theta)\cos(\varphi)$;

a second phase taper value is $2\times n\beta$, wherein n is the column number in which the antenna element is disposed, the number having a value $\geq 1$ and $\leq N$, and $\beta=K\ d_y \sin(\theta)\sin(\varphi)$;

$K=2\pi/\lambda$, wherein $\lambda$ is a wavelength;

$d_x$ is antenna element spacing in the row direction; and $d_y$ is antenna element spacing in the column direction.

* * * * *